US007703552B2

(12) United States Patent
Katagiri

(10) Patent No.: US 7,703,552 B2
(45) Date of Patent: Apr. 27, 2010

(54) WATER TREATMENT PAD FOR CORE DRILL

(75) Inventor: Fujio Katagiri, Hatsukaichi (JP)

(73) Assignee: Shibuya Company, Ltd., Hiroshima (JP)

( * ) Notice: Subject to any disclaimer, the term of this patent is extended or adjusted under 35 U.S.C. 154(b) by 183 days.

(21) Appl. No.: 11/860,628

(22) Filed: Sep. 25, 2007

(65) Prior Publication Data

US 2008/0156538 A1 Jul. 3, 2008

(30) Foreign Application Priority Data

Dec. 28, 2006 (JP) ..... P2006-354046

(51) Int. Cl.
*E21B 21/00* (2006.01)

(52) U.S. Cl. ..... 175/209; 408/59; 408/56; 408/61

(58) Field of Classification Search ..... 175/207, 175/209, 210, 211, 13, 217, 182; 408/67, 408/56, 57, 115 R; 137/312; 166/81.1, 82.1
See application file for complete search history.

(56) References Cited

U.S. PATENT DOCUMENTS 2,145,939 A * 2/1939 Markley ..... 175/209
3,033,298 A * 5/1962 Johnson ..... 175/209
4,471,844 A * 9/1984 Gallagher ..... 175/209
4,625,707 A * 12/1986 Whittaker ..... 125/20
5,860,232 A * 1/1999 Nathenson et al. ..... 37/466
5,987,698 A * 11/1999 Koenig et al. ..... 15/339
6,325,159 B1 * 12/2001 Peterman et al. ..... 175/7

FOREIGN PATENT DOCUMENTS

JP 2003-127131 5/2003

* cited by examiner

*Primary Examiner*—Jennifer H Gay
*Assistant Examiner*—Kipp C Wallace
(74) *Attorney, Agent, or Firm*—Roberts & Roberts, LLP

(57) ABSTRACT

A water treatment pad for core drill, attached on a drilling surface in performing drilling work while supplying cutting water with a core drill, wherein the water treatment pad for core drill comprises: a roughly cylindrical pad main body 10 mounted to surround the core drill and having a drain outlet on a side surface; an inner wall plate 20*a* detachably attached on the inside of the pad main body and formed into an arc shape in cross section when attached and wherein a pressure space communicating with the drain outlet is formed between the inner wall plate and an inner surface of the pad main body. As an attachment structure of the inner wall plate 20*a*, preferably, the guide 12 formed with a fitting groove 13 in the top rear face of the pad main body 10 is provided on a circumference thereof so that the inner wall plate 20*a* is fitted.

14 Claims, 11 Drawing Sheets

(a)

(b)

(c)

PRIOR ART

PRIOR ART

WATER TREATMENT PAD FOR CORE DRILL

BACKGROUND OF THE INVENTION

1. Field of the Invention

The present invention relates to a water treatment pad (hereinafter referred to as a "pad") used in drilling objects to be drilled, such as concrete structures, stone, base rock and steel structures, with a core drill.

2. Description of the Related Art

As a device for drilling concrete structures or the like, core drills are known. In drilling work with a core drill, the core drill in a rotating state is pressed against a predetermined drilling position and is moved downward to form holes. The drilling work will generate fragments and dust particles of concrete structures. To prevent them from scattering, the drilling work is generally performed while water is being supplied to drilling positions. The water supply is useful for cooling a core bit as well. The drilling work to be performed with such water supply conventionally uses water treatment pads as proposed in Japanese Patent Laid-Open Publication No. 2003-127131, Registered Utility Model No. 305895 Specification.

As shown in FIG. 13, a water treatment pad 100 is roughly cylindrical and is disposed on a drilling surface of a concrete structure or the like so as to surround a drilling position. Moreover, the water treatment pad has a drain outlet 102 (drain) on the side of the pad main body 101 to permit inside water to be discharged. Drilling with the water treatment pad 100 is performed while water supplied to a drilling position through a hollow portion in a core drill is being discharged from the drain 102. This permits fragments and dust particles generated during drilling to be discharged from a drilling position together with water to prevent the fragments and the like from scattering. For the purpose of drainage, in addition to natural drainage by attaching a hose to a drain outlet, there is proposed a system which performs forcible drainage by means of a suction force obtained by connecting a vacuum type cleaner (hereinafter referred to as a "cleaner") for more efficient drainage.

As such a water treatment pad, a single-layered cylindrical pad as shown in FIG. 13 has been conventionally widely used, but such a pad has a problem of low drainage efficiency even with a cleaner. This is because a space in which the cleaner is sucked is under such a condition as to communicate with the atmosphere through an opening in the top of the pad (insertion opening in core drill), so that a pressure in the space becomes lower than the atmosphere however intensely suction is continued and drainage will become difficult.

Accordingly, as an improvement of the above-described water treatment pad, there has been known a pad of a double-layered structure as shown in FIG. 14. The water treatment pad 200 is formed with an inner wall 202 on a circumference between a drain outlet 101 and an opening 201 in the pad main body, and thus permits water to be sucked and discharged through a pressure space formed between an inner surface and the inner wall 202 of the pad main body. The pressure space facilitates formation of a negative pressure by suction of the cleaner, thus improving drainage efficiency.

SUMMARY OF THE INVENTION

However, even the water treatment pad of a double-layered structure does not always provide a significant effect. In other words, to make a pressure space negative, the volume needs to be reduced as much as possible with suction capacity from a drain outlet taken into consideration. Specifically, as shown in FIG. 15, it is necessary to make a cross section ($S_2$) of a pressure space equal to or smaller than a cross section ($S_1$) of a drain outlet. To reduce the cross section ($S_2$) of the pressure space, it is necessary to reduce a clearance between an inner surface and an inner wall of the pad main body, however, reducing the clearance causes concrete fragments, cutting chips or the like generated during drilling work to be easily clogged therein, which makes it difficult to remove them. Failure of the removal would cause them to be stuck by drying, thus making the pad itself unusable. Accordingly, as a water treatment pad, a water treatment pad with a somewhat larger clearance has been used in consideration of maintainability, however, it has a problem of inferior drainage efficiency, resulting in water residue often occurring in the pad. After drilling work, removing a pad with a large amount of residue water left causes the residue water to pollute a working position. For such a reason, use of such a water treatment pad has been practically avoided up to now.

In addition to the above-described problem with drainage efficiency during suction, conventional water treatment pads have a problem of difficult drainage depending upon a work posture. A core drill is used in performing drilling work not only in a perpendicular direction to a floor surface but also in a horizontal direction to a wall surface. FIG. 16 shows a condition of the water treatment pad during wall surface drilling. In the case of wall surface drilling, cutting water, when a drain outlet is faced just under, is discharged toward the drain outlet as it is by gravitation, which causes little occurrence of a problem with availability of drainage (FIG. 16(*a*)). In the case of such a layout, however, with a contact of an outlet of the drain opening with a floor surface or the curvature of a hose connected to the drain outlet taken into consideration, drilling under a wall surface will become difficult. Accordingly, to perform drilling under a wall surface, it is necessary to rotate the water treatment pad and provide the drain outlet aslant or just sideway (FIGS. 16(*b*), 16(*c*)).

When the drain outlet is inclined from a perpendicular direction, the whole cutting water L does not reach the drain outlet, so that residue water $L_o$ occurs. This problem remarkably occurs especially when the drain opening is directed upward from the horizon, and cutting water continues to gather with little discharge and eventually flows out from an opening in the top of the pad (core drill insertion hole). Such a problem cannot be solved even by adopting a pad of a double-layered structure and a cleaner. This is because a conventional pad of a double-layered structure cannot reduce a pressure space as described above, and cannot provide a sufficient suction force of the cleaner.

The present invention is a water treatment pad for core drill which has been made based on the above-described background, and its principal purpose is to provide high drainage efficiency irrespective of postures of drilling work.

To solve the above-described problems, the water treatment pad for core drill, attached onto a drilling surface in performing drilling work while supplying cutting water with a core drill, includes: a roughly cylindrical pad main body mounted to surround the core drill and having a drain outlet on a side surface; an inner wall plate detachably attached onto the inside of the pad main body and formed into an arc shape in cross section when attached. Between the inner wall plate and an inner surface of the pad main body, there is formed a pressure space communicating with the drain outlet.

The present invention is attached with an arc-shaped inner wall plate disposed inside a single-layered pad main body and uses a space formed by the inner wall plate and the pad main body inner surface as a pressure space for improving the suction of a cleaner.

A conventional pad of a double-layered structure forms a pressure space over the overall pad periphery, while a pressure space formed according to the present invention is partial by the arc-shaped inner wall plate and the cross section ($S_3$) becomes smaller than a cross section ($S_2$) of the pad in the double-layered structure (see FIG. 1A and FIG. 1B).

This permits the cross section to be smaller than the cross section of the drain outlet, thus providing efficient drainage by a cleaner. Moreover, the present invention provides a relatively wide clearance between the inner wall plate and the pad inner surface even with reducing the cross section of the pressure space, which causes no fear of the clearance being clogged with cutting chips or the like during drilling work.

Furthermore, the present invention is configured so that the inner wall plate is detachable, by which removing the inner wall plate after the work facilitates removal of cutting chips adhering to the pad inside. Thus, the water treatment pad according to the present invention provides high maintainability.

The attachment structure of the inner wall plate is not particularly limited if the attachment structure allows the inner wall plate to be detachable and can form an arc-shaped space between both ends of the inner wall plate and pad main body inner surface. For example, it may be means of screwing both ends or the top of the arc-shaped inner wall plate by forming threaded holes at required positions in the side surface or the top of the pad main body. However, to facilitate the work at a work site, a simpler structure is available.

Such an attachment structure for inner wall plate has a guide provided at at least one position on an inner periphery formed on an upper back surface of the pad main body and the guide is formed with a fitting groove for fitting the inner wall plate onto the guide. Such guide formation facilitates attachment of the inner wall plate as well as a change of the length or position of the inner wall plate according to a work posture described later.

At least one guide formed with the fitting groove is good enough to use. For example, one guide is formed at a position facing the drain outlet. When the inner wall plate having elasticity is attached, both ends thereof are brought into contact with an inner surface of the pad main body to form a space. Preferably, the space is formed in a circumferential manner. This permits optional adjustment of an attachment position of the inner wall plate, thus forming a pressure space according to a work posture as described later.

Preferably, the guide is provided on a circumference having a diameter of 94/100 to 98/100 of the diameter of an inner surface of the pad main body. In the present invention, a relatively large clearance can be taken between the inner wall plate and an inner surface of the pad main body, however, the above-described position is optimum in consideration of efficient drainage. The circumference formed by the guide means a circle which the central position of the fitting groove draws.

In an embodiment of guide installation, it is preferable to install a plurality of guides on the circumference. At this time, the guides may be installed all over at uniform intervals. However, a complete circle is not always required to be formed. The guides may be arranged in an arc manner. Guide installation may be performed at uniform intervals, however, may be performed in an irregular or continuous manner. Furthermore, a single arc-shaped guide may be used in place of a plurality of guides.

The length of the inner wall plate changes the cross section of a pressure space to be formed. Preferably, the length of the inner wall plate is 1/12 to 4/5 relative to a circumferential length on which the guide is installed. In this range, it is preferable to set a length of the inner wall plate in performing floor surface drilling, that is, in attaching a water treatment pad at 1/12 to 1/3 relative to a circumferential length on which the guide is installed. This is because discharge efficiency is improved by reducing (the cross section of) the pressure space as much as possible. On the other hand, in consideration of wall surface drilling, that is, attachment of a water treatment pad onto a wall surface as well, it is preferable to set the inner wall plate longer than when considering only floor surface drilling, specifically at 1/3 to 4/5 of an inner-peripheral length on which the guide is installed. This is because a range (length) of a pressure space needs to be increased by using a relatively long inner wall plate since the pressure space needs to be brought into contact with cutting water. However, even if the length of the inner wall plate needs to be increased, a length equal to the peripheral length is not required. Drilling work may be performed by preparing for the plurality of inner wall plates in the range and replacing the inner wall plates according to a work posture.

The material of the inner wall plate is not particularly limited. Applicable materials for the inner wall plate are usually resin and metal. The inner wall plate is good enough to be arc-shaped in attaching onto the pad main body, and the inner wall plate before attached may be the one formed into an arc shape or flat plate. By using a flat plate made of resin, metal or the like, both ends thereof are made to abut against a pad inner surface by elasticity, thus forming a pressure space even if the number of installed guides is small. However, both the ends of the inner wall plate may be fixed with the guide (a fitting groove thereof).

In the present invention, it is preferable to use a shielding plate to further reduce the pressure space. The shielding plate has a shape roughly equal to a partial shape of the cross section of a pressure space and is provided between a drain outlet layout position and a lower end of the inner wall plate. Attaching the shielding plate permits the portion to be thrust out of the pressure space, thereby reducing the pressure space. The shielding plate is effective to the pad main body having a bump near the drain outlet as described later and is useful in drilling a wall surface.

The pad main body having an external shape similar to that of a conventional water treatment pad is applicable. The external shape of the pad main body may be such a shape as to have a bump portion at a drain outlet layout position in transverse section shape besides the cylindrical shape. Provision of the bump portion permits cutting water to gather near a drain outlet, thus attaining efficient drainage.

Moreover, preferably, a lower edge of the pad main body is formed with an annular seal member constituted of elastic material. A drilling surface, having many irregularities, can bring a water treatment pad into contact with the drilling surface, thereby preventing cutting water from leaking. Preferably, the material of the annular seal member is specifically mono-foam sponge rubber. This is because the sponge rubber is reduced in use of a cleaner, thereby attaining adhesion to a drilling surface and space reduction.

As described above, the present invention provides efficient discharge of cutting water irrespective of any work posture. The present invention is configured so that an inner wall plate is detachable, thereby attaining easy inside cleaning after work and high maintainability.

DETAILED DESCRIPTION OF THE PREFERRED EMBODIMENTS

With reference to the accompanying drawings, description is given below of preferred embodiments of a water treatment pad for core drill according to the present invention.

Figure 1A:
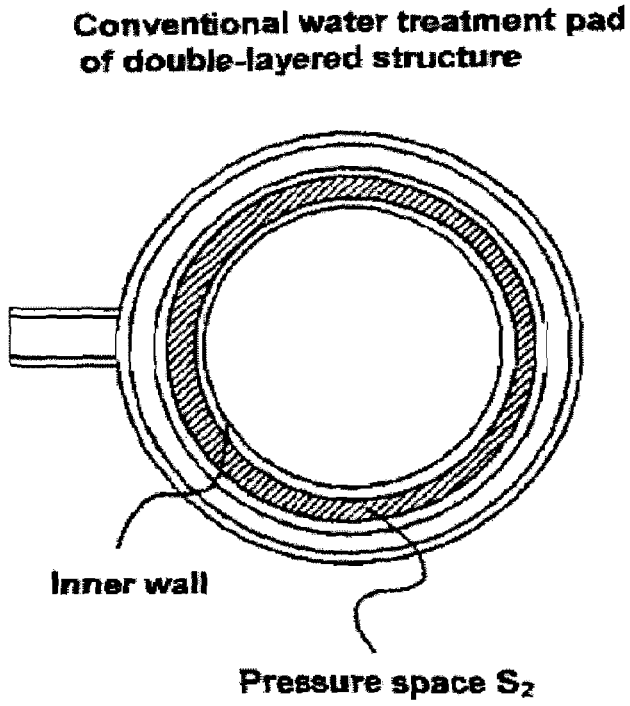
FIG. 1A (PRIOR ART)
FIG. 1A is a view showing a cross section shape of a pressure space in a water treatment pad according to the prior art.
Figure 1B:
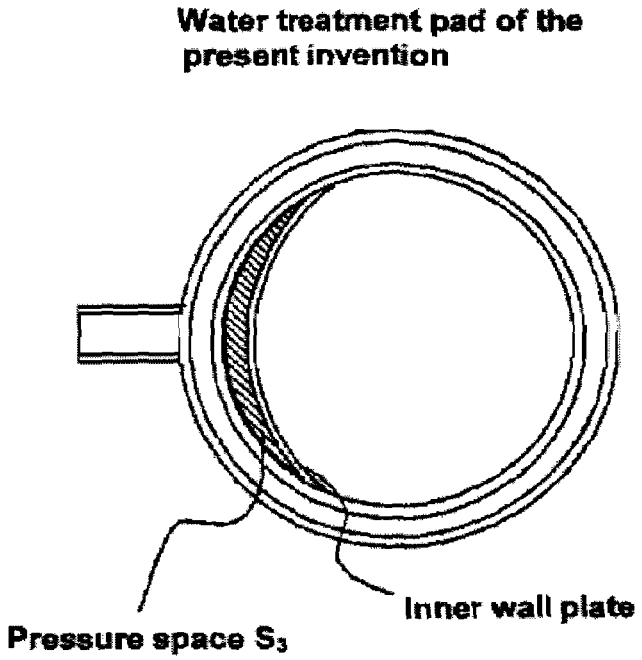
FIG. 1B is a view showing a cross section shape of a pressure space in a water treatment pad according to the present invention.
Figure 2:
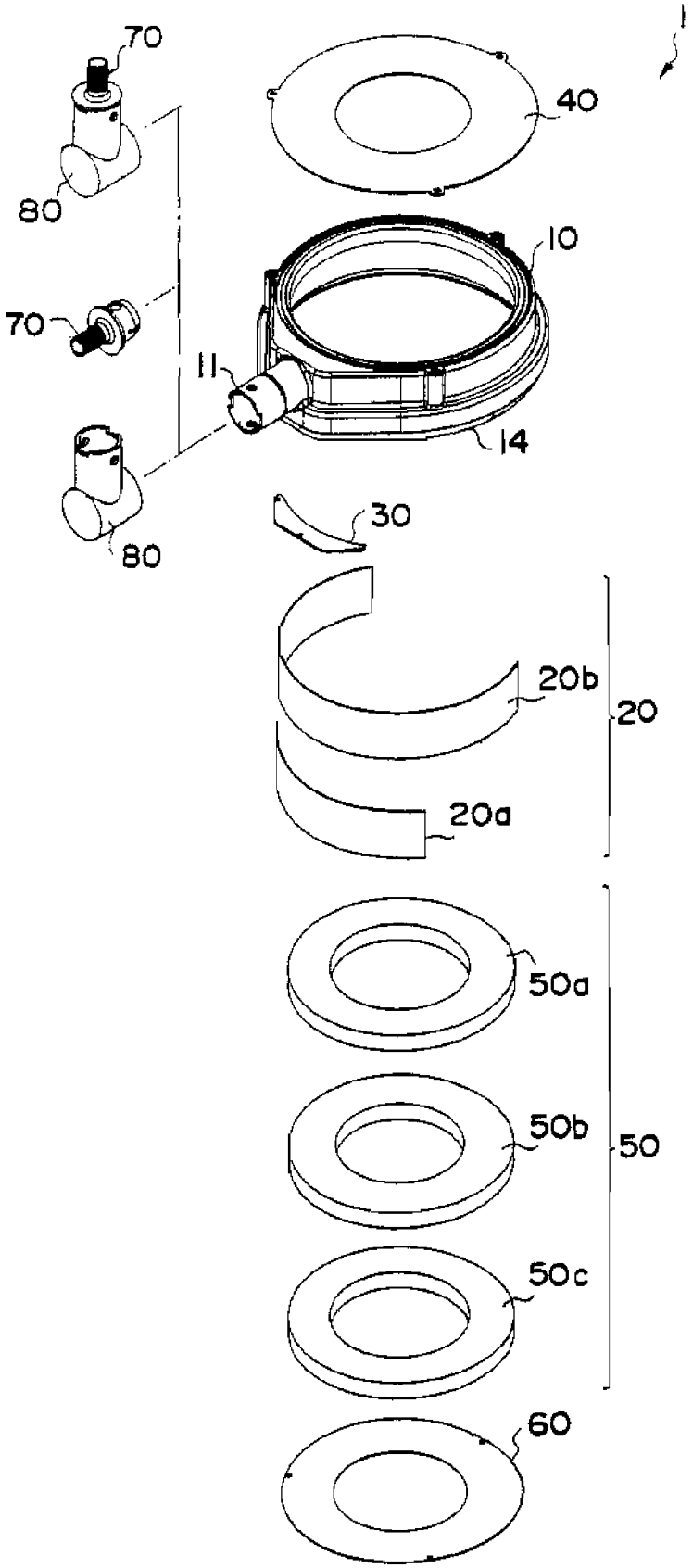
FIG. 2 is a view showing a configuration of each member of a water treatment pad according to the present embodiment.

FIG. 2 shows each member of a water treatment pad. A water treatment pad 1 is constituted of a pad main body 10 having a drain outlet 11, inner wall plates 20 (20*a* and 20*b*) attached to the inside of the pad main body 10 and a shielding plate 30. The inner wall plate 20 and the shielding plate 30 are made of resin. The pad main body 10 is formed with a bump portion at a layout position of the drain outlet 11. The water treatment pad has a top circular plate 40 as a lid on the top of the pad main body. Furthermore, the water treatment pad has circular seal members 50 (50*a*, 50*b*, 50*c*) and a lower circular plate 60 used in drilling a ceiling surface described later. The water treatment pad attached with these components according to the present embodiment has the roughly same appearance as conventional pads.

Figure 3:
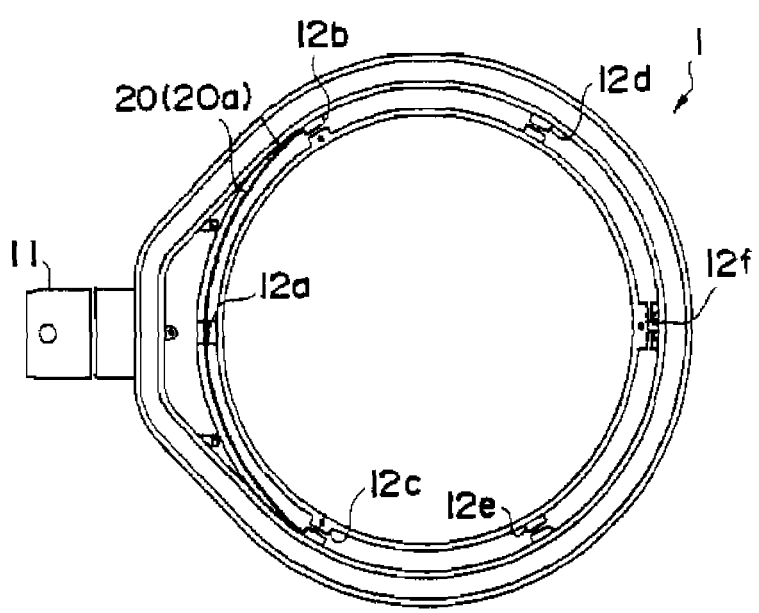
FIG. 3 is a rear view, a sectional view and an expanded sectional view of a water treatment pad according to the present embodiment.
Figure 3:
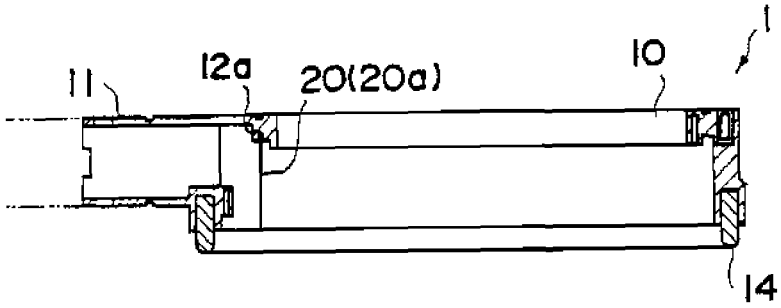
Figure 3:
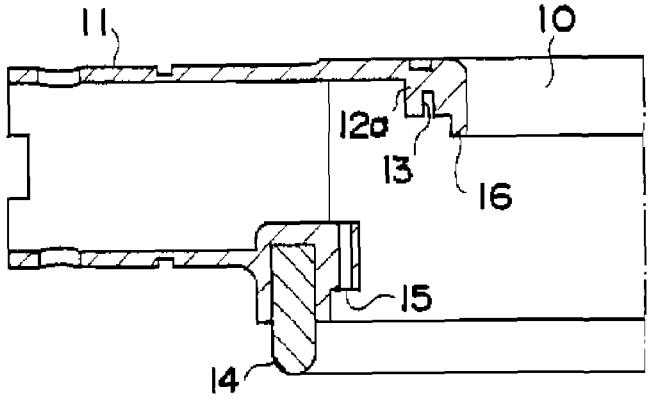

FIGS. 3(*a*)-3(*c*) show a rear view and a sectional view of the pad according to the present embodiment and an expanded sectional view of around the drain outlet 11. The water treatment pad 1 according to the present embodiment is circumferentially arranged with a plurality of guides 12*a*-12*f* (six in the present embodiment) for attaching the inner wall plate 20 on the top rear face of the pad main body 10 (see FIG. 3(*a*)). Each of these guides 12*a*-12*f* has a fitting groove 13 for fixing the inner wall plate 20. The guide 12 is disposed on the circumference of a diameter of 95.7/100 of a circle formed on an inner surface of the pad main body. The pad main body 10 is formed with a step 15 for fixing the shielding plate 30 on an inner surface around the drain outlet and, in the present invention, a horizontal portion at the front end of the bump portion in the present embodiment.

The water treatment pad 1 shown in FIGS. 3(*a*)-3(*c*) are in such a condition that the short inner wall plate 20*a* is attached as an inner wall plate. The inner wall plate in such an attached condition is attached onto only the guide 12*a* facing the drain outlet 11 and both ends of the wall plate are made to abut against an inner surface of the pad main body 10 to form a pressure space. In the case of using an inner wall plate longer than the inner wall plate 20*a*, both ends thereof are fitted into the corresponding guides (12*b*, 12*c*) to form a pressure space.

Figure 4:
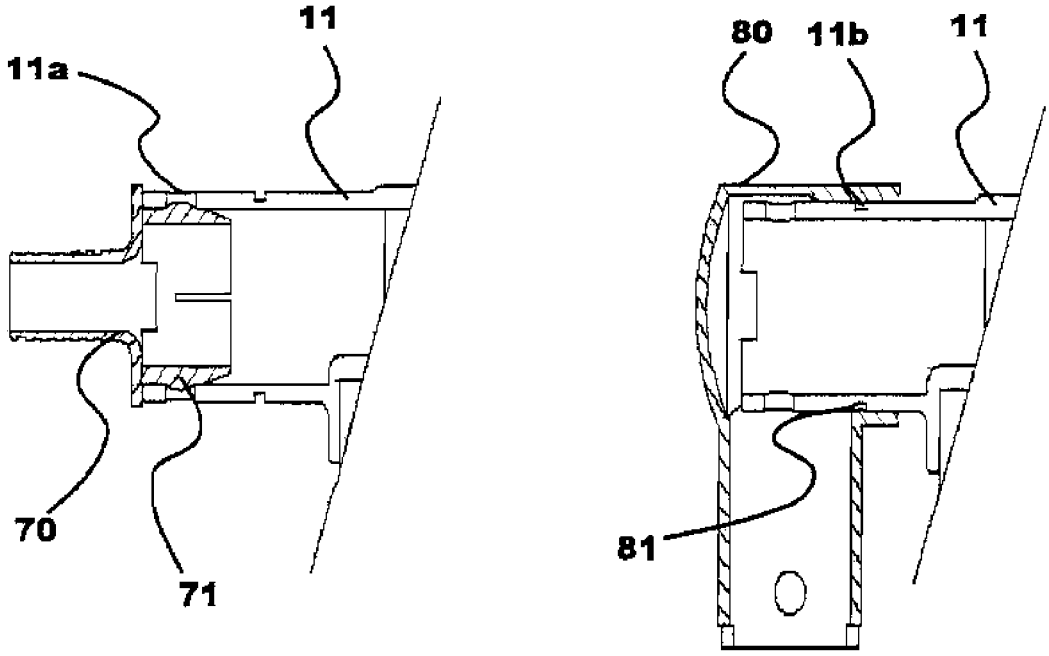
FIG. 4 is a sectional view showing connection state of drain outlet.

In the present embodiment, the drain outlet 11 is connected with a joint 70 used according to the diameter of a hose and a rotatably connected socket 80. FIG. 4 shows a connection state of a joint 70 or a socket 80 with the drain outlet 11. The drain outlet 11 is formed with a fitting hole 11*a* or a groove 11*b* on the end thereof. The joint 70 has a front end a bore of which is adapted to the diameter of a drain hose (not shown) and a drain-outlet-side end formed so as to be inserted into the drain outlet 11. Moreover, the drain-outlet-side end of the joint 70 is formed with a protrusion 71, which is fitted into the fitting hole 11*a* in the drain outlet 11 for fixing. On the other hand, the socket 80 is a roughly L-shaped cylindrical body and is formed with a peripheral protrusion 81 on the drain-outlet-side end, which is fitted into the groove 11*b* in the drain outlet 11 for fixing. The socket 80, being rotatable along the groove 11*b*, can change a discharge direction of cutting water according to a work posture. The joint 70 and the socket 80 are selectively used as necessary according to the diameter of a drain hose or a work posture and can connect the joint 70 to the socket 80.

First Embodiment

Drilling Floor Surface

Figure 5:
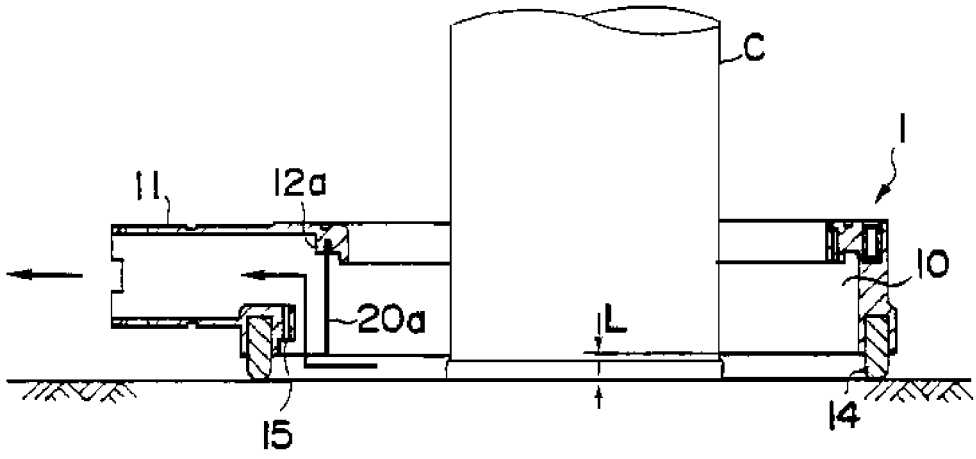
FIG. 5 is a view showing water treatment pad layout condition in drilling floor surface.

To drill a floor surface with the water treatment pad 1 according to the present embodiment, the water treatment pad 1 is composed of the pad main body 10 and the inner wall plate 20*a*. The shielding plate 30 may be included in the water treatment pad 1. In drilling work, as shown in FIG. 5, the water treatment pad is attached onto a floor surface and a vacuum cleaner (not shown) is connected to the drain outlet 11. In installation, the pad 1 is fixed from the above, by which the sponge rubber 14 at the lower end of the pad main body 10 contracts to keep a static suction head by the cleaner low. After attachment and fixing of the water treatment pad 1, a core drill C is located at a drilling position from a top opening and a drive motor (not shown) is actuated to start drilling.

During drilling work, cutting water is supplied from the inside of the core drill C and the cutting water rises to a position of a cutting water line L, then, the cutting water is sucked by the cleaner.

Figure 6:
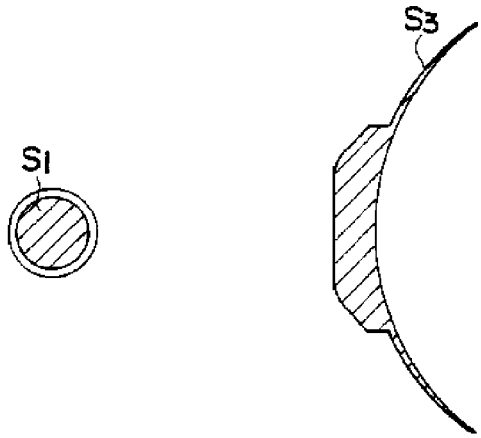
FIG. 6 is a view showing cross section of pressure space in water treatment pad according to the present embodiment.

The cross section of a pressure space in drilling a floor surface is as shown in FIG. 6 and can be set so as to be smaller than that of a conventional pad and specifically so as to be equal to or smaller than the cross section of the drain outlet. This structure permits cutting water to be efficiently sucked and discharged and, after completion of drilling work, cutting water hardly remains in the pad 1.

After completion of drilling work, internal cleaning can be performed only by removing the pad 1 and then the inner wall plate 20*a*. At this time, cutting chips and the like can be removed easily even if they remain around the drain outlet.

Second Embodiment

Drilling Wall Surface

Figure 7:
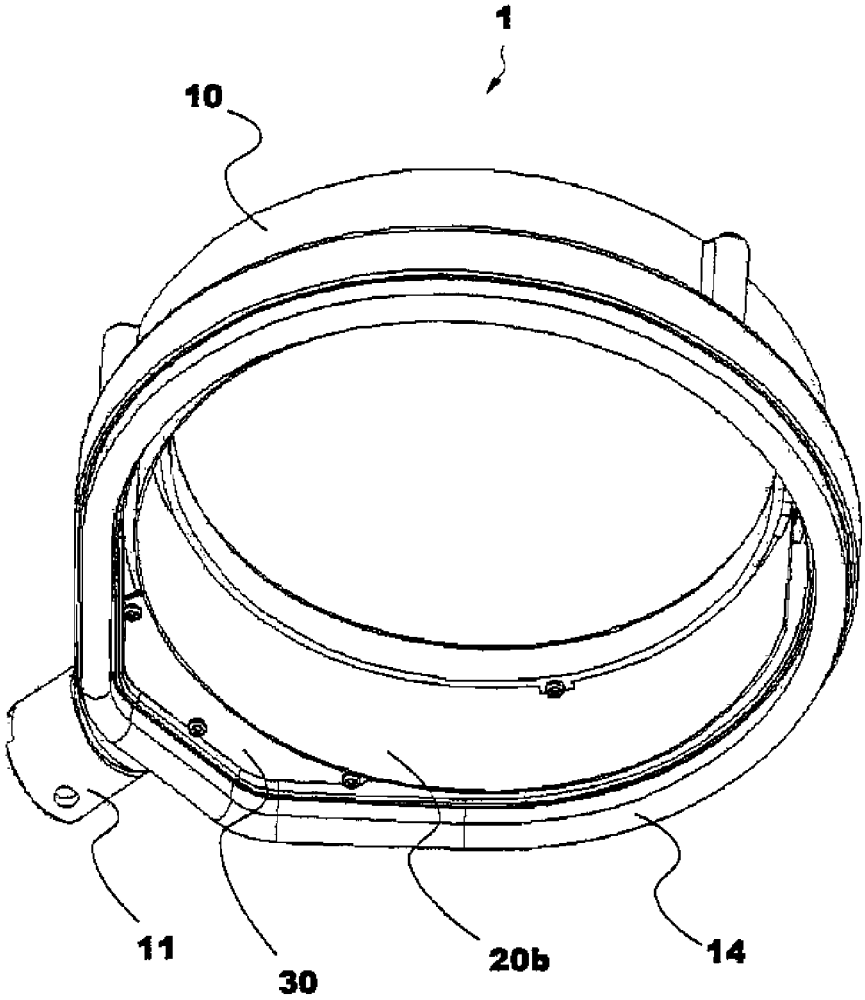
FIG. 7 is a perspective rear view showing a configuration water treatment pad in drilling wall surface.

To drill a wall surface with the water treatment pad 1 according to the present embodiment, the water treatment pad 1 is composed of the pad main body 10, the inner wall plate 20*b* and the shielding plate 30. FIG. 7 shows a perspective rear view of a state where these members are combined. The shielding plate 30 in the present embodiment is a roughly trapezoidal plate member adapted to a shape of around the drain outlet 11. Attaching the shielding plate 30 permits a space formed by a bump portion near the drain outlet 11 to be thrust out of the pressure space, thus reducing the volume (cross section) of the pressure space.

The inner wall plate 20*b* used in drilling a wall surface is longer than the inner wall plate 20*a*. This is because the position of the pressure space should be adjusted in accordance with the attachment state of the pad 1. In other words, as described below, drilling a wall surface needs adjusting orientation of the drain outlet in consideration of a drilling position and the curvature of a drain hose, by which a positional relationship between cutting water and the drain outlet changes. The water treatment pad 1 according to the present embodiment can adjust the position of the pressure space by moving and fitting the inner wall plate 20*b* along the plurality of attached guides 12*a*-12*f*.

Figure 8:
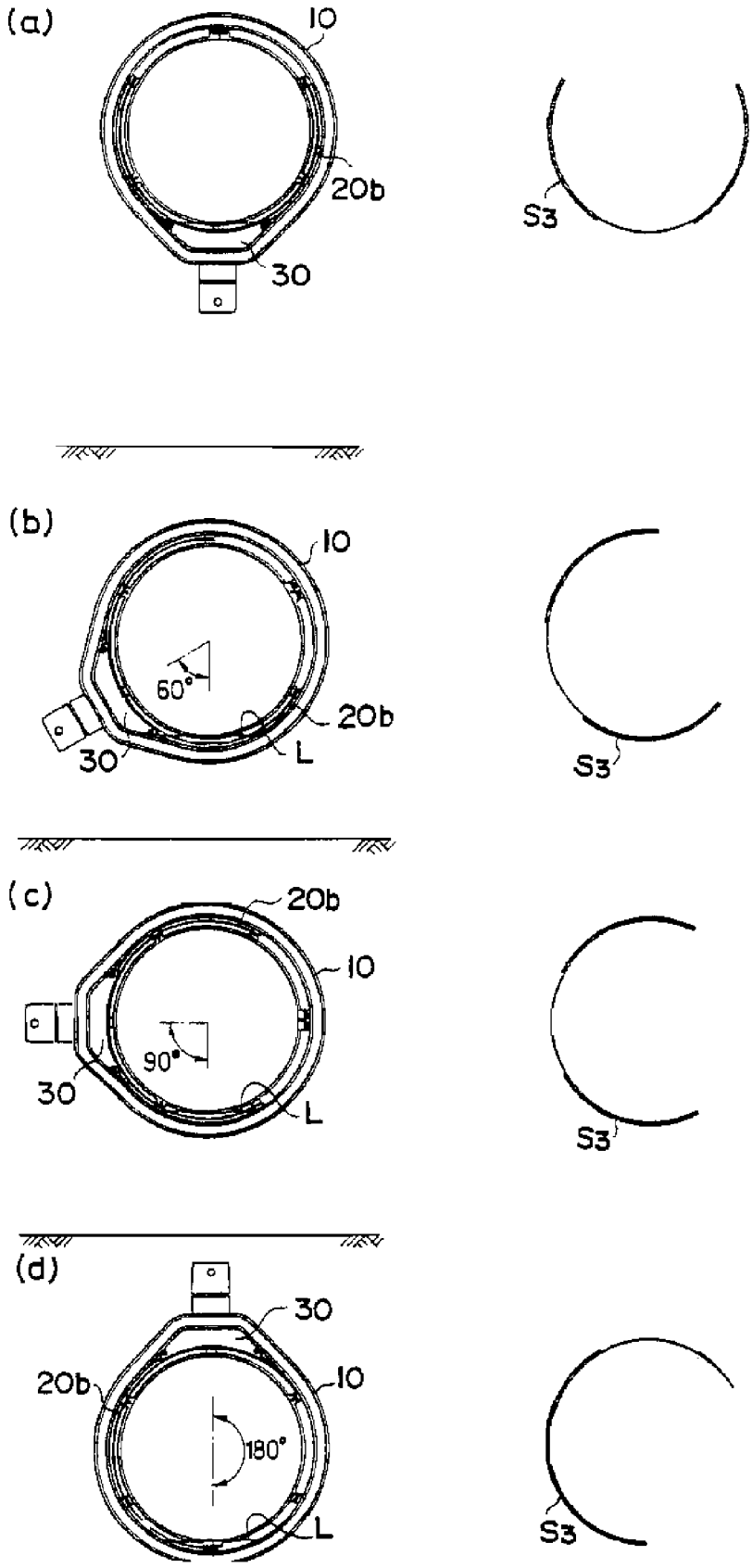
FIG. 8 is a view showing positions of inner wall plate and cross sections of pressure space when orientation of water treatment pad is changed.

FIGS. 8(*a*)-8(*d*) are rear views of the pad 1 showing positions of the inner wall plate 20*b* when an orientation of the water treatment pad (an angle of the center shaft to perpendicular direction of drain outlet 11) is changed and views showing cross section shapes of formed pressure spaces. As shown in FIG. 8(*a*), when the drain outlet faces just therebelow (an angle 0°), drainage is possible irrespective of the position of the inner wall plate 20*b* (in FIG. 8A, the inner wall plate is disposed at such a position that the right and left are even). On the other hand, in bringing a drilling position nearer to a floor surface, the drain outlet should be tilted. FIG. 8(*b*) shows an example of a state where the inner wall plate is tilted by an angle of 60°. At this time, adjusting a position of the inner wall plate permits formation of a pressure space in which the drain outlet 11 communicates with a cutting water line at the pad lower portion. Similarly, when the drain outlet 11 faces the horizontal direction (an angle of 90°) and when the drain outlet 11 faces just above there (an angle of 180°), the position of the inner wall plate 20*b* is shifted and fitted so as to contact the cutting water line, thus forming an effective pressure space (FIG. 8(*c*)).

As shown in right figures of FIGS. 8(*a*)-8(*d*), cross sections $S_3$ of pressure spaces formed at the time of these layouts are of fine arc shape formed by a combination of the inner wall plate 20*b* and the shielding plate 30. This is smaller in cross section than an annular pressure space of a conventional pad in double-layered structure. The cross section $S_3$ is equal to or smaller than that of the drain outlet 11, which permits water treatment without remaining water by making effective use of a suction effect of the cleaner.

The process for drilling a wall surface using the water treatment pad 1 is roughly the same as that for drilling a floor surface described above. Furthermore, maintenance (internal cleaning) is in a like manner.

Third Embodiment

Drilling Ceiling Surface

The water treatment pad according to the present embodiment is applicable to drilling a ceiling surface. In this case, the water treatment pad 1 is constituted of the pad main body 10 and the lower circular plate 60. In drilling a ceiling surface, the inner wall plates 20*a*, 20*b* and the shielding plate 30 do not have to be used, but may be provided.

Figure 9:
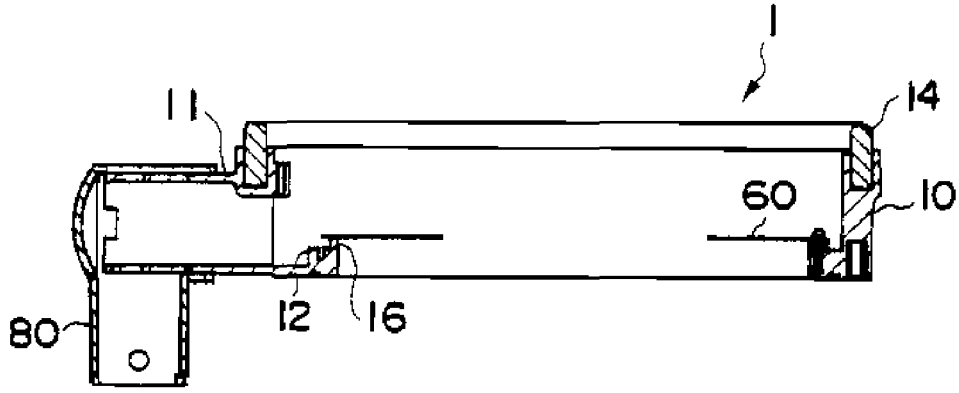
FIG. 9 is a sectional view showing a configuration of water treatment pad in drilling a ceiling surface.

FIG. 9 is a sectional view of the water treatment pad 1. The lower circular plate 60 has a hole for inserting a core drill in the center thereof, and the diameter of the hole is a little larger than the outside diameter of the core drill. Specifically, it is preferable to define a diameter of 1.01-1.2 times as large as the outside diameter of a core drill used. Too small hole diameter may impair rotation of the core drill, while too large hole diameter may fail in suction of the cleaner, thus leaking cutting water. The guides 12*a*-12*f* are formed with a protrusion portion 16 the top of which is flat so as to support the lower circular plate 60.

Figure 10:
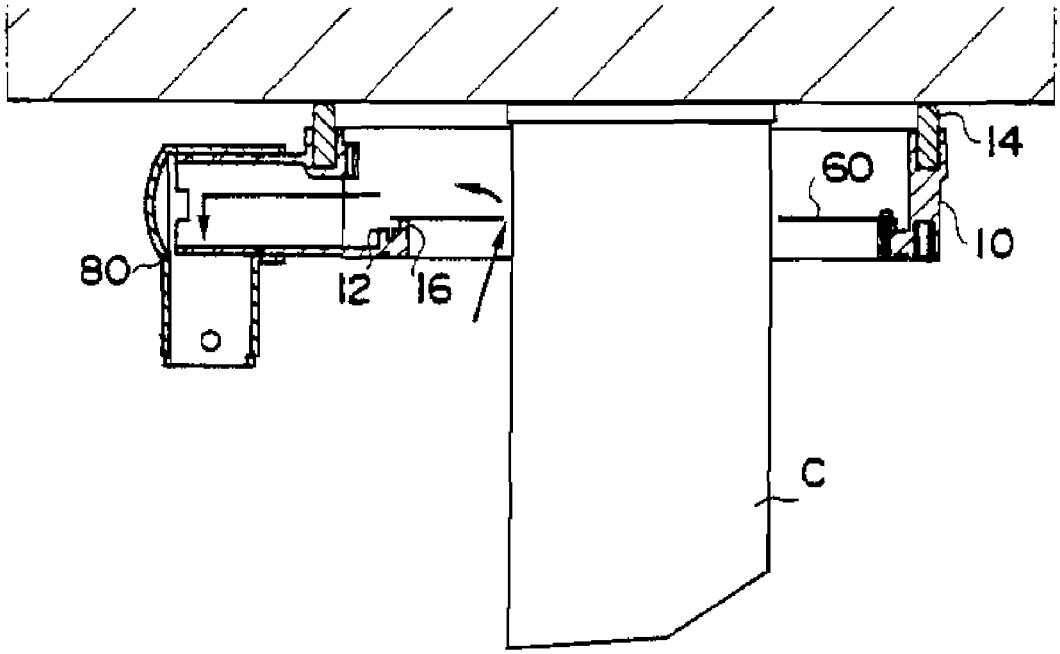
FIG. 10 is a sectional view showing layout condition of water treatment pad in drilling a ceiling surface.

Drilling a ceiling surface is basically performed in the same way as drilling a floor surface. After fixing of the water treatment pad, the core drill C is advanced while cutting water is being supplied. FIG. 10 is a sectional view of the water treatment pad 1 during the drilling work. A clearance between the outside diameter of the core drill C and a hole in the lower circular plate 60 acts as an intake hole in performing suction by the cleaner and, by setting the hole diameter of the plate as described above, the cross section of the clearance can be set so as to be equal to or smaller than that of the drain outlet 11, thus continuing drainage from the drain outlet 11 without leaking cutting water from the clearance. This permits prevention of remaining water after completion of work for no contamination of the periphery of a drilling surface.

Drilling a ceiling surface can make more effective use of gravity than drilling a wall surface, thus performing water treatment without using a cleaner. In this case, the water treatment pad is constituted of the pad main body 10, the upper circular plate 40, the circular seal members 50 (50*a*, 50*b*, 50*c*) and the lower circular plate 60.

Figure 11:
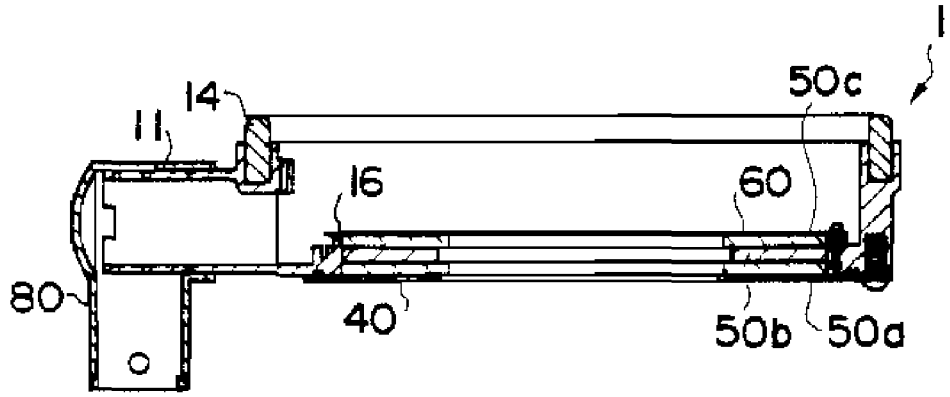
FIG. 11 is a sectional view showing a configuration of water treatment pad in drilling a ceiling surface without using a cleaner.

FIG. 11 is a sectional view of the water treatment pad 1. The circular seal members 50 (50*a*, 50*b*, 50*c*) are rubber sponge discs having an outside diameter roughly equal to an opening in the pad main body 10 and every disc has a hole into which a core drill is insertable In the circular seal members 50*a*, 50*c*, the diameter of the hole is set so as to be roughly equal to or a little smaller than the outside diameter of a core drill used. A hole in the circular seal member 50*b* is larger than the outside diameter of the core drill used and specifically is set so as to be roughly equal to the outside diameter of a core drill one size larger than the core drill used. The circular seal member 50 has a thickness roughly equal to the thickness of an opening in the pad main body 10 on the whole. The upper circular plate 40 is a plate for fixing the circular seal member 50.

Figure 12:
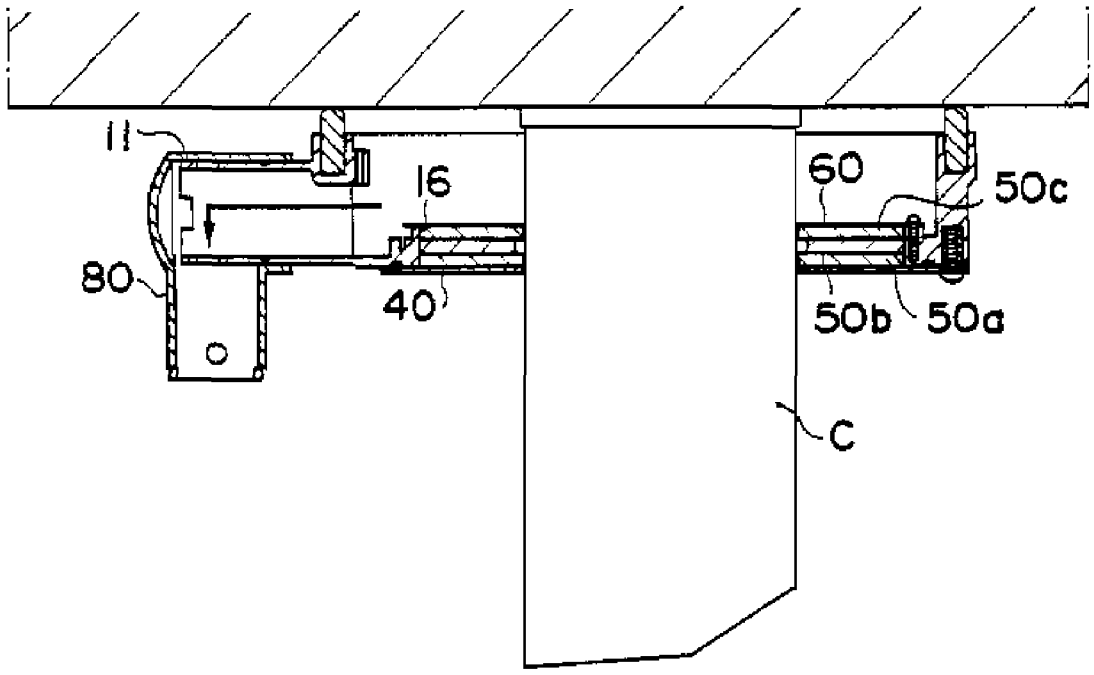
FIG. 12 is a sectional view showing layout condition of water treatment pad in drilling a ceiling surface without using a cleaner.
Figure 13:
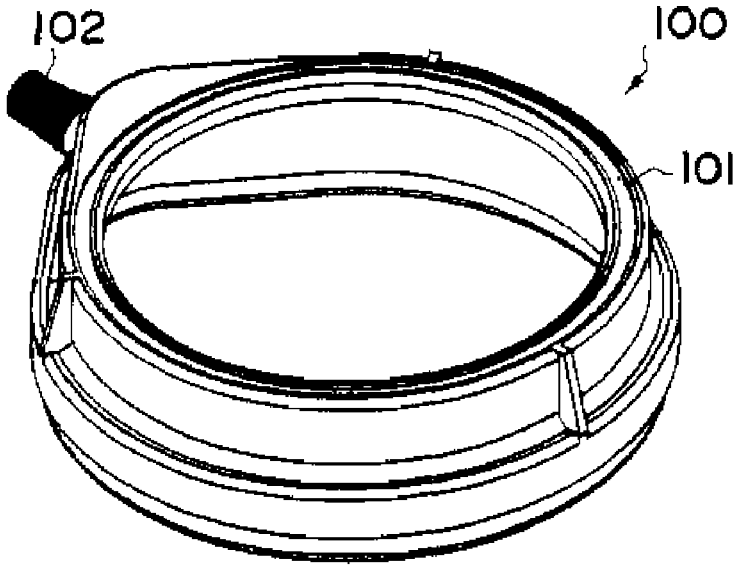
FIG. 13 is an external view and a sectional view of a conventional water treatment pad.
Figure 13:
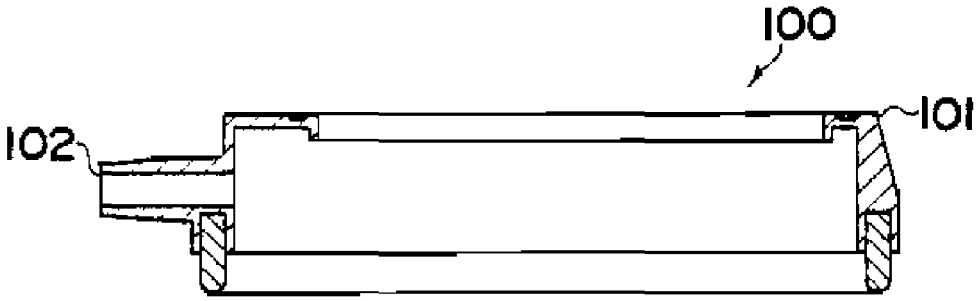
Figure 14:
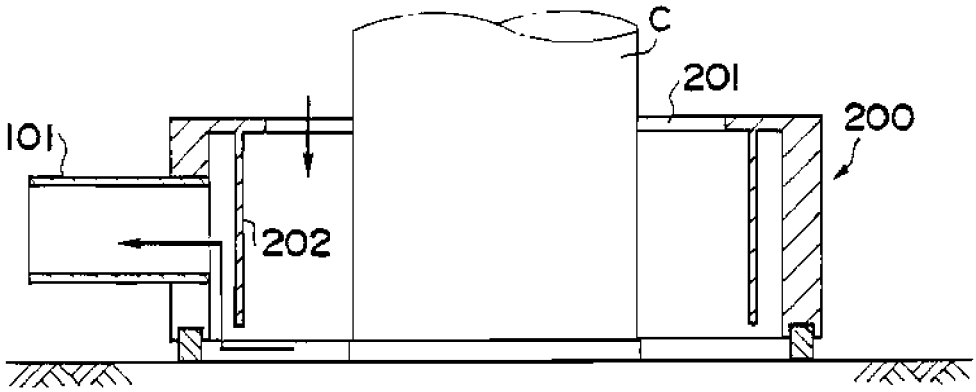
FIG. 14 PRIOR ART
FIG. 14 is an external view and a sectional view of a conventional water treatment pad in double-layered structure.
Figure 15:
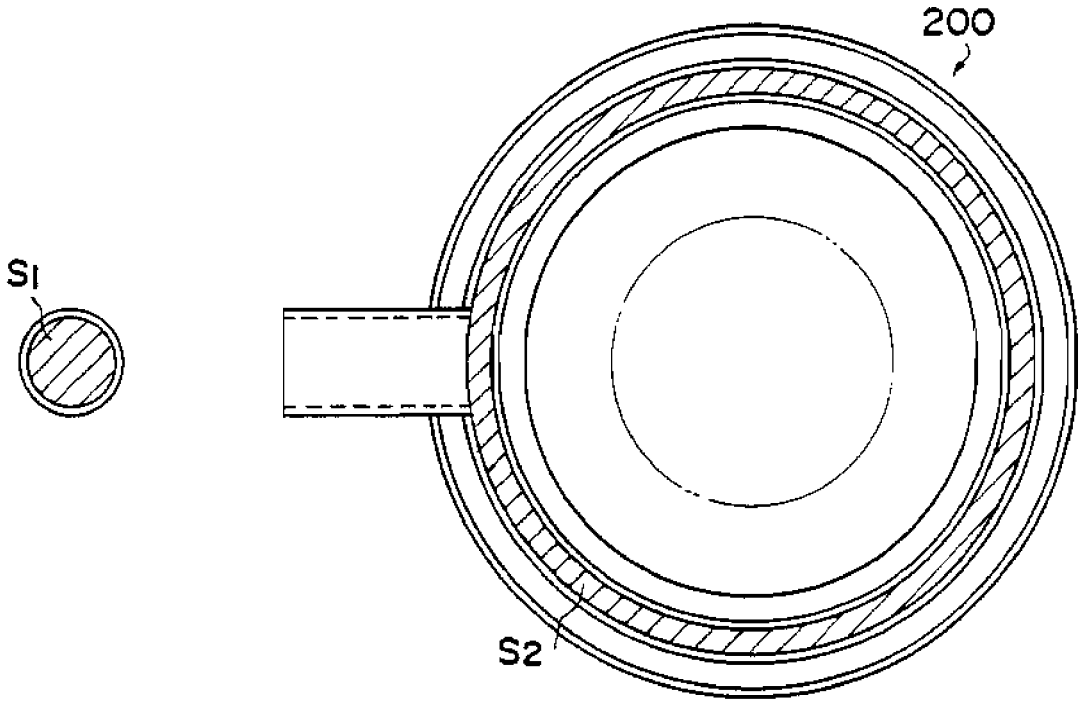
FIG. 15 PRIOR ART
FIG. 15 is a view showing cross section shape of pressure space in a conventional water treatment pad of conventional double-layered structure.
Figure 16:
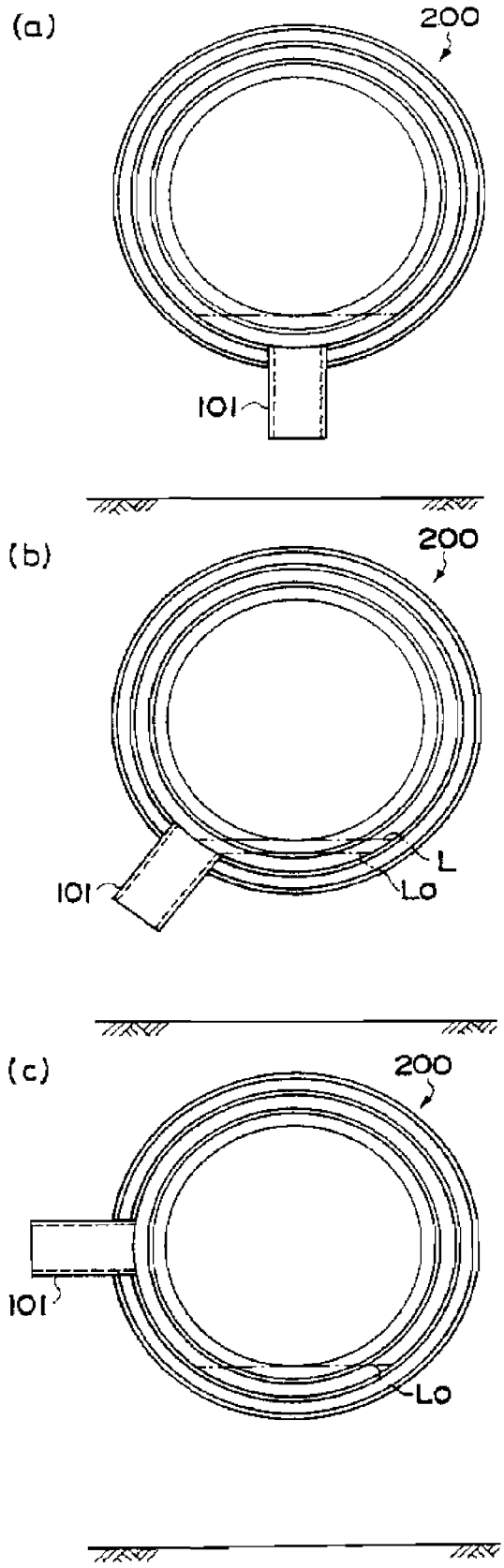
FIG. 16 is a view showing layout condition in drilling wall surface with a conventional water treatment pad of double-layered structure.

FIG. 12 is a sectional view of the water treatment pad 1 during drilling of a ceiling surface. The core drill C is in a free state from the top plate 40 and the bottom plate 60, however, comes into contact with the circular seal members 50*a*, 50*c*, so that the inside of the pad main body is an airtight space. On the contrary, a clearance between the circular seal member 50*b* and the outside of the core drill C is filled with grease, thus lubricating the core drill C to assist rotation thereof. By setting the inside of the pad main body as to be airtight in this way, drainage can be performed from the drain outlet 11 without leaking cutting water from the clearance. This permits prevention of remaining water after completion of work for no contamination of the periphery of a drilling surface.

As the water treatment pad according to the present embodiment, a pad having a bump portion (cutting water pool) around the drain outlet is described above, however, the shape of the pad main body may use a circle having no bump portion.

What is claimed is:

1. A water treatment pad for core drill, attached on a drilling surface in performing drilling work while supplying cutting water with a core drill, comprising:

a roughly cylindrical pad main body mounted to surround the core drill and having a drain outlet on a side surface; and an inner wall plate detachably attached on the inside of the pad main body and formed into an arc shape in cross section when attached, wherein a pressure space communicating with the drain outlet is formed between the inner wall plate and an inner surface of the pad main body; and wherein a guide is provided at at least one position on an inner periphery formed on the top rear face of the pad main body and the guide is formed with a fitting groove in which the inner wall plate is fitted.

2. The water treatment pad for core drill as claimed in claim 1, wherein the guide is provided on a circumference having a diameter of $^{94}/_{100}$ to $^{98}/_{100}$ of a circle formed by an inner surface of the pad main body.

3. The water treatment pad for core drill as claimed in claim 1, wherein the length of the inner wall plate is $^{1}/_{12}$ to $^{4}/_{5}$ of a circumferential length on which the guide is installed.

4. The water treatment pad for core drill according to claim 1, wherein the inner wall plate is a flat plate made of elastic material.

5. A water treatment pad for core drill, attached on a drilling surface in performing drilling work while supplying cutting water with a core drill, comprising:

a roughly cylindrical pad main body mounted to surround the core drill and having a drain outlet on a side surface; and an inner wall plate detachably attached on the inside of the pad main body and formed into an arc shape in cross section when attached, wherein a pressure space communicating with the drain outlet is formed between the inner wall plate and an inner surface of the pad main body;

wherein a shielding plate which has a shape roughly equal to a partial shape of the cross section of the pressure space is provided between the drain outlet and a lower end of the inner wall plate.

6. A water treatment pad for core drill, attached on a drilling surface in performing drilling work while supplying cutting water with a core drill, comprising:

a roughly cylindrical pad main body mounted to surround the core drill and having a drain outlet on a side surface; and an inner wall plate detachably attached on the inside of the pad main body and formed into an arc shape in cross section when attached, wherein a pressure space communicating with the drain outlet is formed between the inner wall plate and an inner surface of the pad main body; and at least one circular plate attachable to a top opening of the pad main body and having an opening of a diameter of 1.01-1.2 times as large as the outside diameter of a core drill.

7. The water treatment pad for core drill as claimed in claim 6, further comprising at least one circular seal member having a diameter roughly equal to a top opening of the pad main body and formed out of elastic material having a hole in which a core drill is inserted and a top circular plate attachable onto the top face of the pad main body and supporting the circular seal member.

8. The water treatment pad for core drill as claimed in claim 1, wherein the pad main body has a bump portion at a layout position of the drain outlet in a shape of a cross section thereof.

9. The water treatment pad for core drill as claimed in claim 1, wherein an annular seal member formed out of elastic material is provided on a lower edge of the pad main body.

10. The water treatment pad for core drill as claimed in claim 2, wherein the length of the inner wall plate is $^{1}/_{12}$ to $^{4}/_{5}$ of a circumferential length on which the guide is installed.

11. The water treatment pad for core drill according to claim 1, wherein the inner wall plate is a flat plate made of elastic material.

12. The water treatment pad for core drill according to claim 2, wherein the inner wall plate is a flat plate made of elastic material.

13. The water treatment pad for core drill according to claim 3, wherein the inner wall plate is a flat plate made of elastic material.

14. The water treatment pad for core drill according to claim 10, wherein the inner wall plate is a flat plate made of elastic material.

* * * * *